United States Patent [19]

Schneller

[11] Patent Number: 4,763,455

[45] Date of Patent: Aug. 16, 1988

[54] INTERIOR CORNER DRYWALL BEAD

[75] Inventor: Joseph W. Schneller, Williamsville, N.Y.

[73] Assignee: National Gypsum Company, Dallas, Tex.

[21] Appl. No.: 505,369

[22] Filed: Jun. 16, 1983

[51] Int. Cl.[4] ..... E04B 1/41

[52] U.S. Cl. ..... 52/255; 52/371; 52/717.1

[58] Field of Search ..... 52/255, 254, 256, 257, 52/366, 371, 288, 717, 417, 259

[56] References Cited

U.S. PATENT DOCUMENTS

| | | | |
|---|---|---|---|
| 1,030,044 | 6/1912 | Wittbecker | 52/255 |
| 1,167,837 | 6/1916 | Pride | 52/255 |
| 1,361,843 | 12/1920 | Flagge | 52/257 |
| 1,537,758 | 5/1925 | Fischer | 52/256 |
| 2,138,470 | 11/1938 | Bischof | 52/255 |
| 2,796,641 | 6/1957 | Wollaeger | 52/255 |
| 2,904,992 | 9/1959 | Cruser | 52/256 |
| 3,201,908 | 8/1965 | Arnold | 52/255 |
| 3,201,910 | 8/1965 | Keesee | 52/255 |
| 3,765,138 | 10/1973 | Bentle | 52/255 |
| 3,956,861 | 5/1976 | Rasmussen | 52/717 |

FOREIGN PATENT DOCUMENTS

| | | | |
|---|---|---|---|
| 686254 | 5/1964 | Canada | 52/254 |
| 850864 | 9/1970 | Canada | 20/52.5 |
| 1248986 | 11/1960 | France | 52/255 |
| 1298439 | 6/1962 | France | 52/255 |

*Primary Examiner*—David A. Scherbel
*Assistant Examiner*—Caroline D. Dennison
*Attorney, Agent, or Firm*—Robert F. Hause

[57] ABSTRACT

An elongate thin strip, with two similar flanges forming a 90° angle, each flange having a shallow step whereby a recessed area for joint compound is provided, when used as a drywall inside corner bead.

10 Claims, 1 Drawing Sheet

INTERIOR CORNER DRYWALL BEAD

This invention relates to an interior corner bead for use with a joint compound, for forming a very uniform interior corner, with the wall surface, joint compound surface and corner bead surface all forming a generally coplanar monolithic surface, particularly adapted for use in a gypsum board, drywall construction.

Interior corners in drywall construction are presently being constructed by filling the joint between two adjacent wallboards forming the interior corner, adhering paper joint tape, centered, over the joint, and subsequently applying a cementitious joint compound over the tape, concealing the joint and the tape and creating the appearance of a plaster wall interior corner. Most commonly, this is accomplished by a workman applying joint compound over the half of the tape on one wall and over a narrow section of the wall adjacent the tape edge, in a relatively uniform coating, tapered from about 0.010 inch thickness at the corner to as thin as possible at the outer edge, followed by returning to the job, after this has dried and hardened, and applying more joint compound in like fashion on the other wall. A fourth and fifth return to the job to apply additional coats of joint compound may also be required.

If the workman does not let the joint compound on one wall dry and harden before attempting to apply it to the second wall, the soft material on the first wall is highly likely to be disturbed during application on the second wall, or, alternatively, the second wall is likely to not be smooth, since forming a corner, using a common broad knife, requires the workman, when applying joint compound and smoothing it, on the second wall, to move the broad knife edge precisely along the surface of the material on the first wall, without gouging material from the first wall, or leaving an unsmoothed area adjacent the first wall, a very difficult task to accomplish consistently.

It is an object of the present invention to provide an interior corner bead for drywall construction.

It is a further object to provide means for concealing a wallboard interior corner by forming a monolithic appearing corner.

It is a still further object to provide means for concealing a wallboard interior corner that requires a very low level of skill for high quality results, and with less labor involved.

These and other objects and advantages of the present invention will be more fully apparent when considered in relation to the preferred embodiments thereof as set forth in the specification and as shown in the drawings in which.

Figure 1:
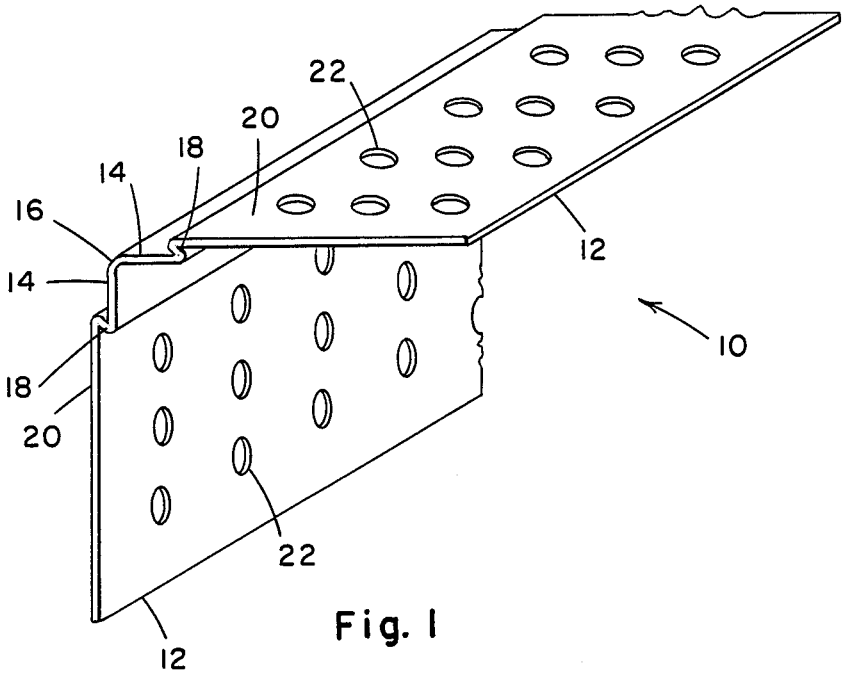
FIG. 1 is an isometric view of an interior corner drywall bead in accordance with the invention.

Referring to FIG. 1 there is shown a short section of the novel elongate drywall interior corner bead 10, which is preferably formed from folded and punched thin sheet metal of about 0.02 inch thickness, such as a galvanized sheet steel, but alternatively may be an extruded and and punched rigid vinyl material of about the same dimensions.

Interior corner bead 10 includes two opposite symmetrical flanges 12, 12 extending at a 90° angle, one from the other. Each flange 12 includes a narrow elongate inner portion 14, extending from the junction 16 of the two flanges 12, 12, to a narrow elongate web 18. Web 18 extends outwardly from narrow portion 14 at an angle of about 45°. At the outer edge of web 18, a narrow elongate outer portion 20 extends away from junction 16 in a direction parallel to narrow elongate inner portion 14, thus being also at angle of about 45° to web 18. Outer portion 20 has a plurality of circular holes 22, of about $\frac{1}{8}$ inch diameter disposed in a plurality of rows, all about $\frac{1}{4}$ inch apart, center to center.

Referring to the drawings it will be seen that the structure of interior corner bead 10 of the present invention consists essentially of a thin sheet of metal with five lengthwise-extending parallel folds formed in alternating directions. More particularly, corner bead 10 consists of one of the outer portions 20 being connected by a rightward fold to one of the webs 18 which is connected by a leftward fold to one of the inner portions 14 which is connected by a rightward fold to the other inner portion 14 which is connected by a leftward fold to the other web 18 which is connected by a rightward fold to the other outer portion 20.

In a preferred form, the flange inner portion 14 is about $\frac{3}{8}$ inch wide, the flange outer portion 20 is about $\frac{7}{8}$ inch wide, the angled adjoining web 18 is about $\frac{1}{8}$ inch wide, and the distance between the plane of inner portion 14 and outer portion 20 is about 1/16 inch. Normally the interior corner bead will be manufactured and sold in lengths of about 8 feet, but it can be made in any desired length.

Figure 2:
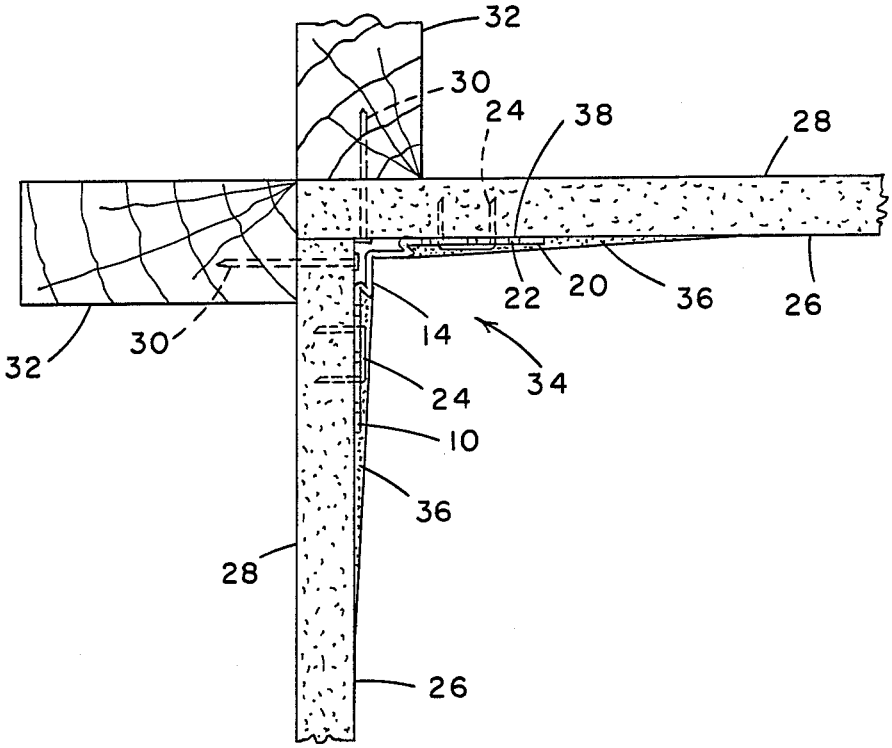
FIG. 2 is a cross-section of a drywall interior corner constructed with the interior corner bead of FIG. 1.

As seen in FIG. 2, interior corner bead 10 is affixed by staples 24 to the inner faces 26 of a pair of gypsum wallboards 28, 28, which are affixed with nails 30 to a pair of studs 32, 32, forming a drywall interior corner 34. Drywall joint compound 36 is adhered over the narrow outer portion 20 of each flange 12 and extends about two additional inches in width onto the adjacent wallboard inner face 26. Joint compound 36 also extends through each of the holes 22 in outer portions 20 to bond with the wallboard surface 38 thereunder. Joint compound 36 is applied with a 4-inch wide broad knife, which during application has one edge riding along the inner portion 14 of flange 12 and the other edge riding along a portion of the wallboard surface 38 which is 4 inches away.

A light pressure is applied to the broad knife so that the joint compound is forced into holes 22 and scraped off a narrow portion of the wallboard surface at the outer edge, and so that a monolithic surface is created by the combination of the wallboard surface 38, the surface of the joint compound 36 and the surface of the flange inner portion 14.

If a joint compound having very low shrinkage characteristics is used, such as a joint compound which hardens as a result of a setting reaction of an ingredient as opposed to the common hardening merely by drying, it is possible with the present invention to affix the interior corner bead 10, and apply one coat of joint compound 36 which will set and provide a satisfactory interior corner 34, without having to make any return visits to the job site.

Normally it will be preferable with either kind of joint compound to return once to the job, after the first coat has hardened, and apply a second finish coat. This is still advantageous relative to present methods employing paper tape as the reinforcement of the corner joint, which require the workman to return two or three times.

The free floating condition of the two flange inner portions 14, 14 at the junction 16 permits considerable relative movement of the two wallboards without causing any cracking to occur, since the angle between the two inner portions is free to change by an increase or a decrease from the original 90° angle, without this change necessarily being equal throughout the full length of the interior corner 34.

Having completed a detailed disclosure of the preferred embodiments of my invention, so that others may practice the same, I contemplate that variations may be made without departing from the essence of the invention or the scope of the appended claims.

I claim:

1. An interior corner bead for drywall 90° interior corners comprising a thin elongate strip with five lengthwise-extending parallel folds formed in alternating directions, said strip having a cross-section including two flanges extending at 90° one to the other and forming, at the junction of said flanges a 90° corner, said flanges each having an inner portion which forms said 90° corner with said other inner portion, a narrow web extending outwardly from the outer edge of said inner portion, and an outer portion which extends away from said junction in a plane parallel to said inner portion.

2. An interior corner bead as defined in claim 1 wherein the plane containing said inner portion is spaced about 1/16 inch from the plane of said outer portion.

3. An interior corner bead as defined in claim 2 wherein each said outer portion contains a plurality of spaced apart substantially circular holes.

4. An interior corner bead as defined in claim 2 formed from folded and punched galvanized steel.

5. An interior corner bead as defined in claim 2 formed from extruded and punched rigid vinyl.

6. A drywall interior corner comprising a pair of gypsum wallboards in substantially abutting relationship and forming an interior angle of substantially 90° therebetween, an interior corner bead as defined in claim 1 having the two flange outer portions thereof affixed to said wallboards and said two flanges forming an interior angle of 90° conforming to but slightly inward from the 90° corner formed by said wallboard and a thin layer of joint compound disposed over and adhered to both said outer portions and both said wallboards, said joint compound having a surface which extends along one edge from a flush relationship with said flange inner portion in a tapered relationship to an opposite edge flush with said wallboard.

7. A drywall interior corner as defined in claim 6 wherein said joint compound is approximately 1/16 inch thick adjacent said flange inner portion.

8. A drywall interior corner as defined in claim 7 wherein each said flange outer portion contains a plurality of spaced apart substantially circular holes, and said joint compound extends through said holes and is bonded thereunder to said wallboard.

9. A drywall interior corner as defined in claim 7 wherein said interior corner bead is formed from folded and punched galvanized steel.

10. A drywall interior corner as defined in claim 7 wherein said interior corner bead is formed from extruded and punched rigid vinyl.

* * * * *